US009577309B2

(12) United States Patent
Tamura

(10) Patent No.: US 9,577,309 B2
(45) Date of Patent: Feb. 21, 2017

(54) HIGH-FREQUENCY WAVE TRANSMITTING DEVICE INCLUDING A CONNECTING PORTION FOR CONNECTING A WAVEGUIDE TO AN ANTENNA

(71) Applicant: Molex, LLC, Lisle, IL (US)

(72) Inventor: Naoyoshi Tamura, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/229,121

(22) Filed: Mar. 28, 2014

(65) Prior Publication Data

US 2014/0333388 A1 Nov. 13, 2014

(30) Foreign Application Priority Data

Mar. 29, 2013 (JP) ..... 2013-073768

(51) Int. Cl.
*H01P 5/107* (2006.01)
*H01P 3/16* (2006.01)

(52) U.S. Cl.
CPC ..... *H01P 5/107* (2013.01); *H01P 3/165* (2013.01)

(58) Field of Classification Search
CPC ..... H01P 5/107
USPC ..... 333/26
See application file for complete search history.

(56) References Cited

U.S. PATENT DOCUMENTS

| | | | | |
|---|---|---|---|---|
| 6,268,781 | B1 | 7/2001 | Schaffner | |
| 6,384,694 | B1 | 5/2002 | Tanizaki et al. | |
| 6,870,438 | B1 * | 3/2005 | Shino et al. | 333/26 |
| 6,977,560 | B2 | 12/2005 | Itoh et al. | |
| 7,132,905 | B2 | 11/2006 | Sano | |
| 8,854,152 | B2 | 10/2014 | Uchimura et al. | |
| 2005/0285694 | A1 * | 12/2005 | Saitoh | 333/26 |
| 2006/0119450 | A1 * | 6/2006 | Kato et al. | 333/26 |
| 2007/0188258 | A1 * | 8/2007 | Ohno et al. | 333/26 |

FOREIGN PATENT DOCUMENTS

| | | | |
|---|---|---|---|
| CN | 1701462 | A | 11/2005 |
| CN | 200965910 | Y | 10/2007 |
| JP | 60-146504 | A | 8/1985 |
| JP | 04-51701 | A | 2/1992 |
| JP | 11-261312 | A | 9/1999 |
| JP | 2003-318614 | | 11/2003 |
| KR | 2006-0010867 | A | 2/2006 |

* cited by examiner

*Primary Examiner* — Benny Lee
(74) *Attorney, Agent, or Firm* — James A. O'Malley

(57) ABSTRACT

To reduce electromagnetic wave transmission loss, a connecting portion is provided on the end portion of a waveguide. A connecting portion has a first half and a second half, each made of a dielectric material. An antenna formed on a printed circuit board is interposed between the first half and the second half. The connecting portion has conductive portions and. The conductive portions have a shape corresponding to the cross-section of the conductive portion of the waveguide in cross-section orthogonal to the direction in which the circuit board extends, and surround the first half and the second half.

7 Claims, 8 Drawing Sheets

HIGH-FREQUENCY WAVE TRANSMITTING DEVICE INCLUDING A CONNECTING PORTION FOR CONNECTING A WAVEGUIDE TO AN ANTENNA

CROSS REFERENCE TO RELATED APPLICATIONS

The Present Disclosure claims priority to prior-filed Japanese Patent Application No. 2013-073768, entitled "High-Frequency Transmission Device," filed on 29 Mar. 2013 with the Japanese Patent Office. The content of the aforementioned Patent Application is fully incorporated in its entirety herein.

BACKGROUND OF THE PRESENT DISCLOSURE

The Present Disclosure relates, generally, to a transmission device for transmitting high-frequency waves such as millimeter waves and microwaves.

The waveguide disclosed in Japanese Patent No. 3902062, the content of which is fully incorporated in its entirety herein, is a waveguide for transmitting millimeter waves and microwaves and which is made of a dielectric material with a conductive coating. In the '062 patent, the conductive material provided on the surface of the waveguide has a slit on the bottom surface in the end portion. The end portion of the waveguide is arranged on a printed circuit board, and the slit is positioned on an electrical wire functioning as the antenna which is formed in the printed circuit board.

In the structure disclosed in the '062 patent, electromagnetic waves emitted upwards from the electrical wire pass through the slit and into the wave guide, and are transmitted through the waveguide. However, the electromagnetic waves emitted downward from the electrical wire (the electromagnetic waves emitted towards the printed circuit board) enter the waveguide with difficulty, and significant transmission loss occurs.

SUMMARY OF THE INVENTION

It is an object of the Present Disclosure to provide a high-frequency transmission device able to reduce electromagnetic wave transmission loss.

The high-frequency transmission device of the Present Disclosure transmits electromagnetic waves from an antenna formed in a printed circuit board. The device is a waveguide having a conductive portion and a dielectric portion. In a cross-section orthogonal to the direction of extension, the device has a waveguide in which a conductive portion surrounds a dielectric portion. It also has a connecting portion which includes one or more conductive portions and a dielectric portion, and which is provided on the end portion of the waveguide. The dielectric portion of the connecting portion has a first half and a second half interposing the antenna in a first direction, or the thickness direction of the circuit board. The one or more conductive portions of the connecting portion, in cross-section orthogonal to a second direction, or the extension direction of the circuit board, has a shape corresponding to the cross-section of the conductive portion of the waveguide, and surrounds the first half and the second half.

In the Present Disclosure, the one or more conductive portions of the connecting portion surround the first half and the second half in cross-section orthogonal to the second direction along the circuit board, and have a shape corresponding to the cross-section of the conductive portion of the waveguide. In this way, the waveguide and the connecting portion can be connected so that the electromagnetic waves emitted from the antenna on the circuit board side can be transmitted smoothly to the waveguide. As a result, electromagnetic wave transmission loss can be reduced. In the Present Disclosure, the first half and/or the second half can be integrated with or separate from the dielectric portion of the waveguide. The one or more conductive portions of the connecting portion may be integrated with or separate from the conductive portion of the waveguide. In the Present Disclosure, a portion of the circuit board may function as the first half or the second half.

In one aspect of the Present Disclosure, at least one of the first half and the second half is separate from the dielectric portion of the waveguide, and the boundary between the end portion of the waveguide and at least one of the first half and the second half is covered by a shield formed with a conductor. In this way, transmission loss can be reduced even when there is misalignment or a gap between the first or second half and the end portion of the waveguide 20. The shield may be integrally formed with the conductive portion of the waveguide or the conductive portion of the connecting portion, or may be separate from the conductive portion of the waveguide or the conductive portion of the connecting portion.

In one aspect of the Present Disclosure, the end portion of the wave guide may extend in the second direction, and the first half and the second half each may connect to the waveguide in the second direction. In this way, the first half and the second half are aligned linearly with the end portion of the waveguide, and transmission loss can be reduced.

In one aspect of the Present Disclosure, at least one of the first half and the second half may be separate from the waveguide, the end portion of the waveguide may be held by a first connector, and the connecting portion may be held by a second connector mated with the first connector. This makes it easier to connect the waveguide to the connecting portion.

In one aspect of the Present Disclosure, at least one of the first half and the second half may be integrated with the waveguide. This reduces the number of parts.

BRIEF DESCRIPTION OF THE DRAWINGS

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DETAIL DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1A:
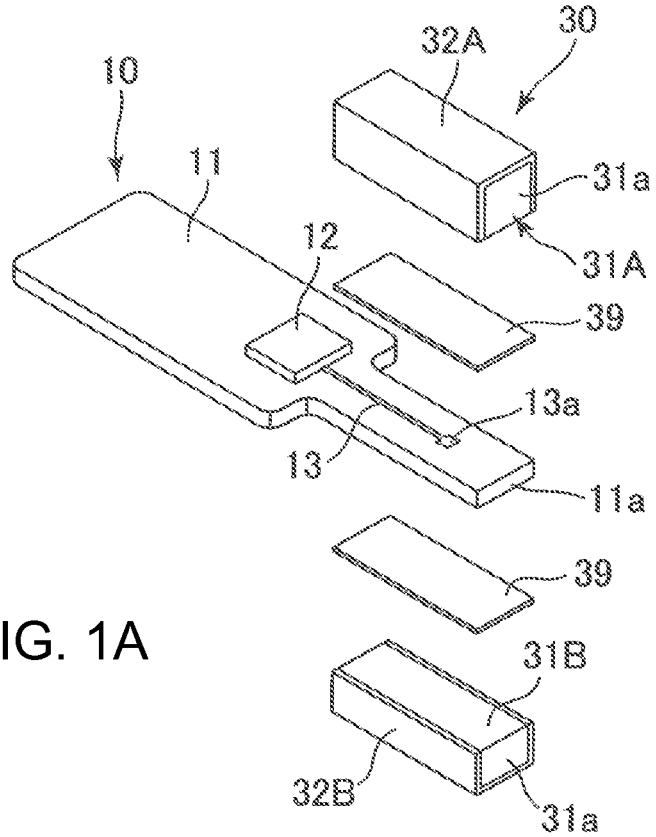
FIGS. 1(*a*) and 1(*b*) are perspective views of the high-frequency transmission device in an embodiment of the Present Disclosure, in which FIG. 1(*a*) is an exploded perspective view and FIG. 1(*b*) is a perspective view showing a mated circuit board and a connecting portion.
Figure 1B:
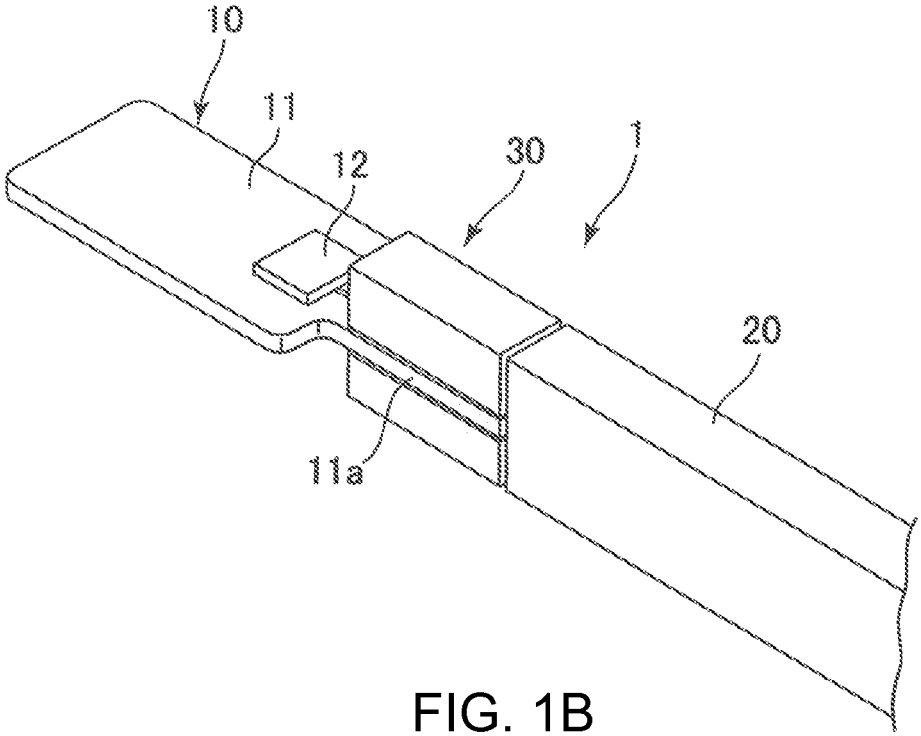

As shown in FIG. 1(*b*), the high-frequency transmission device 1 includes a circuit board 10. The circuit board 10 has a base 11 formed from an insulating material such as polyimide. An IC chip 12 is mounted on the base 11 to send and/or receive high-frequency waves such as millimeter waves or microwaves. As shown in FIG. 1(*a*), an antenna 13 connected to the IC chip 12 is formed on the base 11. In this example, the antenna 13 is linear and extends from the IC chip 12, and a rectangular plate portion 13*a* is formed in the end portion. The antenna 13 may be connected directly to the IC chip 12. For example, the antenna 13 may be connected to the IC chip 12 via an electrical line such as a microstrip line formed on the base 11.

In the example shown in FIGS. 1(*a*) and 1(*b*), the base 11 has a mounting portion 11*a* on which the antenna 13 is formed. The mounting portion 11*a* has a width corresponding to a waveguide 20 (shown in FIG. 1(*b*)) and the connecting portion 30 in plan view. More specifically, the mounting portion 11*a* has a width which is smaller than the portion on which the IC chip 12 is mounted. The mounting portion 11*a* of the base 11 may have a width greater than the waveguide 20 and the halves 31A, 31B (shown in FIG. 1(*a*)).

Figure 2:
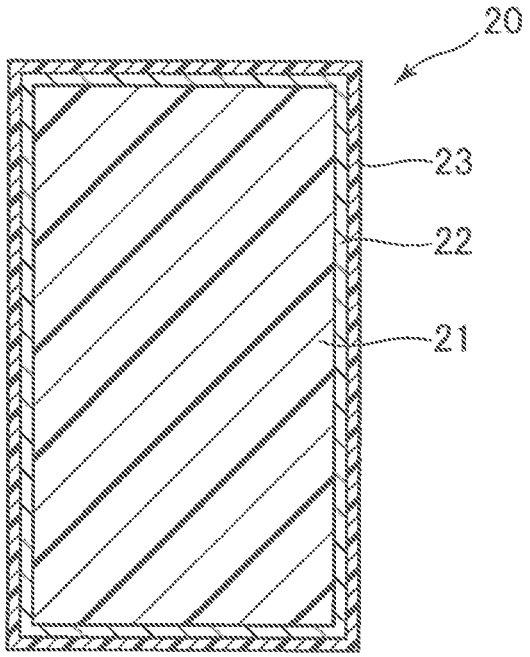
FIG. 2 is a cross-sectional view of the waveguide of FIGS. 1(*a*) and 1(*b*)

The high-frequency transmission device 1 has a waveguide 20 serving as a dielectric waveguide or a conductive waveguide. As shown in FIG. 2, the waveguide 20 has a tube-shaped conductive portion 22 and a dielectric portion 21 provided on the inside. The dielectric portion 21 is made of a flexible resin. The resin in the dielectric portion 21 may be any material with low dielectric loss. Examples include fluororesins such as polytetrafluoroethylene, acrylic resins such as polymethyl methacrylate, as well as polyethylene, polystyrene and polycarbonate. The material used in the dielectric portion 21 may be a composite of these materials. The conductive portion 22 is a film of metal (such as copper). The conductive portion 22 is usually metal tape applied to the outer peripheral surface of the dielectric portion 21.

The conductive portion 22 surrounds the dielectric portion 21 in cross-section orthogonal to the extension direction of the waveguide 20. In this example, the dielectric portion 21 has a quadrilateral cross-section. The conductive portion 22 is formed on the four surfaces of the dielectric portion 21 (the top surface, the bottom surface, the right surface and the left surface). The conductive portion 22 does not have to be formed on the end surface of the dielectric portion 21 (the surface facing the circuit board 10), and the end surface of the dielectric portion 21 may remain exposed. The cross-section of the waveguide 20 does not have to be rectangular. For example, the waveguide 20 may have a round cross-section as described below.

The waveguide 20 shown in FIG. 2 is made of an insulating material and has a film-like protective portion 23 covering a conductive portion 22. The protective portion 23 is also tube-shaped, and covers the four surfaces of the conductive portion 22 (the top surface, the bottom surface, the right surface and the left surface). For example, the protective portion 23 can be an insulating tape wrapped around the conductive portion 22.

In the example shown in FIGS. 1(*a*) and 1(*b*), the end portion of the waveguide 20 is arranged so as to extend in the same direction as the antenna 13. A straight line passing through the antenna 13 also passes through the inside of the end portion of the waveguide 20. More specifically, a straight line passing through the antenna 13 passes through the center of the cross-sectional plane of the end portion of the waveguide 20. The end surface of the waveguide 20 is also arranged so as to intersect a horizontal plane including the antenna 13. In other words, the upper half of the end portion of the waveguide 20 is above the horizontal plane including the antenna 13, and the lower half of the end portion of the waveguide 20 is below the horizontal plane including the antenna 13.

As shown in FIG. 1(*a*), the high-frequency transmission device 1 has a connecting portion 30 which is connected to the end portion of the waveguide 20. The connecting portion 30 is mounted on the mounting portion 11*a* of the circuit board 10. The connecting portion 30 has a dielectric portion composed of a first half 31A and a second half 31B. In FIGS. 1(*a*) and 1(*b*), the halves 31A, 31B are formed separately from the waveguide 20 and the circuit board 10. The material of the dielectric portion comprising the first half 31A and the second half 31B can be the same material used in the dielectric portion 21 of the waveguide 20, as shown in FIG. 2. As explained in greater detail below, the connecting portion 30 may be integrated with the waveguide 20. Also, one portion of the circuit board 10 may function as the second half 31B.

The first half 31A and the second half 31B are arranged on opposite side from each other in the thickness direction of the circuit board 10 with the antenna 13 interposed therebetween. The first half 31A is arranged on the top surface of the circuit board 10 (the surface on which the antenna 13 has been formed), and the second half 31B is arranged on the bottom surface of the circuit board 10. The halves 31A, 31B are arranged so that the end surface 31*a* (the surface facing the end surface of the waveguide 20) is positioned on the edge of the circuit board 10.

The connecting portion 30 has a plurality of conductive portions 32A, 32B, as shown in FIG. 1(*a*). The conductive portions 32A, 32B surround the two halves 31A, 31B in the cross-section orthogonal to the direction in which the circuit board 10 extends (the extension direction of the waveguide 20). In this example, conductive portion 32A is formed on the outer surface of the first half 31A, and conductive portion 32B is formed on the outer surface of the second half 31B. As mentioned earlier, the halves 31A, 31B have a rectangular cross-section. Conductive portion 32A is formed on the side surfaces and the top surface of the first half 31A, but not on the bottom surface of the first half 31A (the surface facing the circuit board 10). Similarly, conductive portion 32B is formed on the side surfaces and the bottom surface of the second half 31B, but not on the top surface of the second half 31B (the surface facing the circuit board 10). Together, the conductive portions 32A, 32B have a rectangular cross-section.

When the halves 31A, 31B and the conductive portions 32A, 32B have been arranged in this way, electromagnetic waves emitted upwards from the antenna 13 enter the first half 31A, and electromagnetic waves emitted downwards from the antenna 13 enter the second half 31B. The conductive portions 32A, 32B are not formed in the end surface 31*a* of the halves 31A, 31B (the surface facing the end surface of the waveguide 20). The conductive portions 32A, 32B are formed in the end surface opposite the end surface 31*a* of the halves 31A, 31B, but they do not have to be formed in the end surface on the opposite side.

The conductive portions 32A, 32B have a shape corresponding to the cross-section of the conductive portion 22 of the waveguide 20 in the cross-section orthogonal to the direction of the circuit board 10 (the direction in which the waveguide 20 extends). In other words, the conductive portions 32A, 32B have a cross-sectional shape similar to the conductive portion 22 of the waveguide 20. The cross-section of the conductive portions 32A, 32B is also similar in size to the cross-section of the conductive portion 22 of the waveguide 20. As described above, the conductive portion 22 in this example has a rectangular cross-section (see FIG. 2). The conductive portions 32A, 32B of the connecting portion 30 have a rectangular cross-section over their entirety as mentioned above. Therefore, the conductive portions 32A, 32B are tube-shaped and extend over their entirety in the same direction as the end portion of the waveguide 20 and connect to the conductive portion 22. Here, "tube-shaped" does not necessarily refer to the shape when the two conductive portions 32A, 32B are linked together. The two conductive portions 32A, 32B may have a gap between them. In FIGS. 1(*a*) and 1(*b*), a gap is provided between the lower edge of conductive portion 32A and the upper edge of the conductive portion 32B. In other words, the conductive portions 32A, 32B may be connected conductive portions forming a tube.

The two halves 31A, 31B and the antenna 13 are arranged inside the conductive portions 32A, 32B. In this example, the antenna 13 is in the center of the tube formed by the conductive portions 32A, 32B. The connecting portion 30 and the wave guide 20 have a dielectric material on the inside, and the cross-sectional shape of the connecting portion 30 corresponds to the cross-sectional shape of the waveguide 20.

The combined height of the first half 31A, the second half 31B and the mounting portion 11*a* of the circuit board 10 is substantially equal to the height of the waveguide 20 to which they are connected. The height of the first half 31A and the height of the second half 31B are determined based on the frequency of the electromagnetic waves sent and received via the antenna 13, the relative permittivity of the halves 31A, 31B, and the height of the mounting portion 11*a* of the circuit board 10. The thickness of the base 11 of the circuit board 10 is preferably sufficiently smaller than the wavelength of the electromagnetic waves. In this way, the effect of the base 11 on the phase of the electromagnetic waves can be reduced. When the relative permittivity of the base 11 of the circuit board 10 is greater than that of the dielectric material in the halves 31A, 31B, the height of the second half 31B is preferably lower than the height of the first half 31A. This can reduce the difference between the phase of the electromagnetic waves emitted from the antenna 13 towards the upper conductive portion 32A and the phase of the electromagnetic waves emitted from the antenna 13 towards the lower conductive portion 32B.

The connecting portion 30 can be formed in the following way. Metal plates are bent into a U-shape to form the conductive portions 32A, 32B. Then a resin is formed on the inside of the metal plates and the resin completes the halves 31A, 31B. The connecting portion 30 may also be formed by filling a metal tube with a dielectric resin and then cutting the material.

The first half 31A and the second half 31B in FIGS. 1(*a*) and 1(*b*) are bonded, respectively, to the top surface and the bottom surface of the circuit board 10. These can be bonded using an adhesive or an adhesive sheet on which an adhesive has been applied. In the example shown, the first half 31A and the second half 31B are bonded to the top surface and the bottom surface of the circuit board 10 using an adhesive sheet 39, as shown in FIG. 1(*a*). The first half 31A and the second half 31B do not have to be bonded to the top surface and the bottom surface of the circuit board 10. For example, the first half 31A and the second half 31B may be mounted, respectively, to the top surface and the bottom surface of the circuit board 10 using the fusion or welding methods. The first half 31A and the second half 31B also do not have to be mounted on the circuit board 10. They may be pressed against the top surface and the bottom surface of the circuit board 10 using another member.

The end portion of the waveguide 20 is positioned in the direction of extension relative to the halves 31A, 31B, and the end surface of the waveguide 20 faces the end surface 31*a* of the halves 31A, 31B. The halves 31A, 31B are both connected to the waveguide 20 in the direction of extension for the waveguide 20. In this way, the electromagnetic waves emitted upwards from the antenna 13 are reflected by the conductive portion 32A of the first half 31A towards the waveguide 20. Also, the electromagnetic waves emitted downwards from the antenna 13 are reflected by the conductive portion 32B of the second half 31B towards the waveguide 20. This can reduce electromagnetic wave transmission loss.

Here, "connecting the halves 31A, 31B to the waveguide 20" means arranging the halves 31A, 31B and the waveguide 20 so that the electromagnetic waves are transmitted to the waveguide 20 from the halves 31A, 31B without significant loss. Preferably, the end surface 31*a* of the halves 31A, 31B abuts or is adjacent to the end surface of the waveguide 20. The positional relationship between the halves 31A, 31B and the waveguide 20 is not limited to this. For example, when the end portions of the connecting portion 30 and the waveguide 20 are surrounded by a common shield as explained below, there may be a slight gap between end surface 31*a* of the halves 31A, 31B and the end surface of the waveguide 20.

The direction in which the waveguide 20 and the connecting portion 30 are connected is not limited to the direction in which the waveguide 20 extends. For example, the end portions of the first half 31A and the second half 31B may be bent upwards. The bent end portions of the halves 31A, 31B and the waveguide 20 may then be connected in the vertical direction.

The waveguide 20 and the connecting portion 30 may be connected in many ways. For example, the end surface 31*a* of the connecting portion 30 may be bonded to the end surface of the waveguide 20. Also, the waveguide 20 and the connecting portion 30 may be fixed relative to each other using another member so that the end surface of the waveguide 20 is aligned with the end surface of the connecting portion 30. The end surface of the waveguide 20 may also be pressed against the end surface 31*a* of the connecting portion 30.

Figure 3:
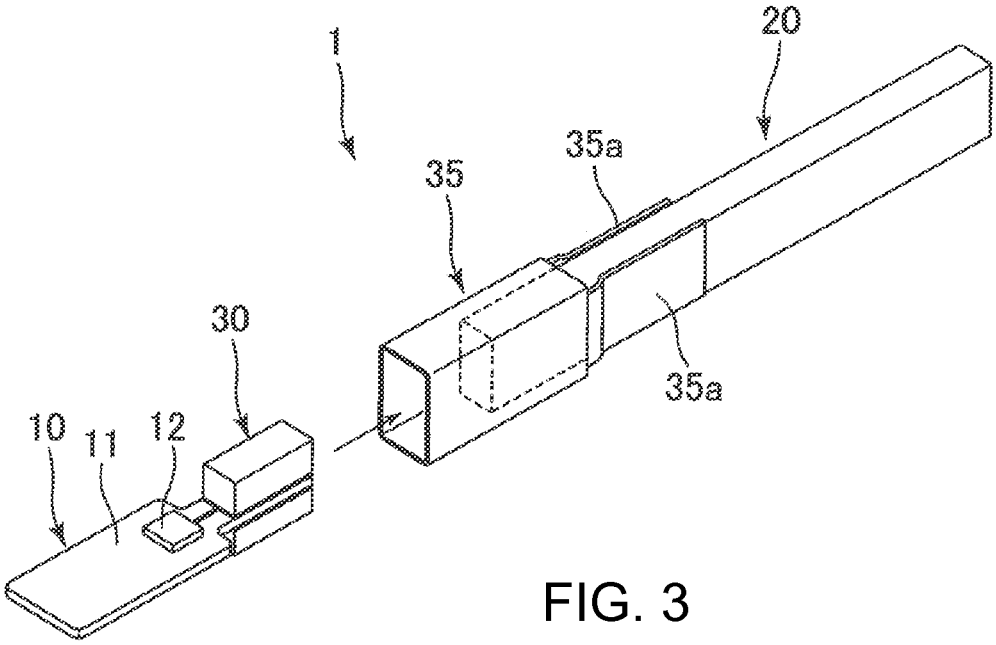
FIG. 3 is a perspective view of the waveguide of FIGS. 1(*a*) and 1(*b*) connected to a connecting portion.

FIG. 3 is a perspective view of an example of a waveguide 20 connected to a connecting portion 30. In the example explained here, the end portion of the waveguide 20 and the connecting portion 30 are arranged inside a shared conductor so that the boundary between the two is covered. More specifically, in the high-frequency transmission device 1 shown in this drawing, a tube-shaped conductive shield 35 is formed using a conductive material with shielding properties. The connecting portion 30 and the end portion of the waveguide 20 are inserted into the conductive shield 35 from opposite sides. By using a conductive shield 35, the transmission loss can be reduced even when there is a misalignment or gap between the end portion of the waveguide 20 and the connecting portion 30. The conductive shield 35 has a cross-sectional shape corresponding to that of the connecting portion 30 and the waveguide 20. More specifically, the conductive shield 35 has a rectangular cross-section. When the waveguide 20 has a round cross-section, the conductive shield 35 also has a round cross-section.

A slight clearance may be provided between the waveguide 20 and the inner surface of the conductive shield 35. A slight clearance may also be provided between the connecting portion 30 and the inner surface of the conductive shield 35. In this way, the end portion of the waveguide 20 and the connecting portion 30 are easier to insert into the conductive shield 35.

The conductive shield 35 preferably has a holding portion 35*a* for holding the connecting portion 30 or the waveguide 20. In the example shown in FIG. 3, the conductive shield 35 has a pair of holding portions 35*a*. The holding portions 35*a* may take the form of plate springs using spring action to clamp the waveguide 20.

A part of the connecting portion 30 (the part on the waveguide 20 side) may be positioned inside the conductive shield 35, and the remaining part may remain outside of the conductive shield 35. The entire connecting portion 30 may be positioned inside the conductive shield 35. In this case, the conductive portions 32A, 32B formed on the surface of the halves 31A, 31B as shown in FIG. 1(*a*) are not required. In this case, the conductive portions 32A, 32B formed on the surface of the halves 31A, 31B are not required. In this case, the connecting portion 30 may use the conductive shield 35 as conductive portion instead of the conductive portions 32A, 32B formed on the surface of the halves 31A, 31B. In this case, the connecting portion 30 with the conductive shield 35 serving as the conductive portion has a cross-sectional shape corresponding to the waveguide 20.

Figure 4:
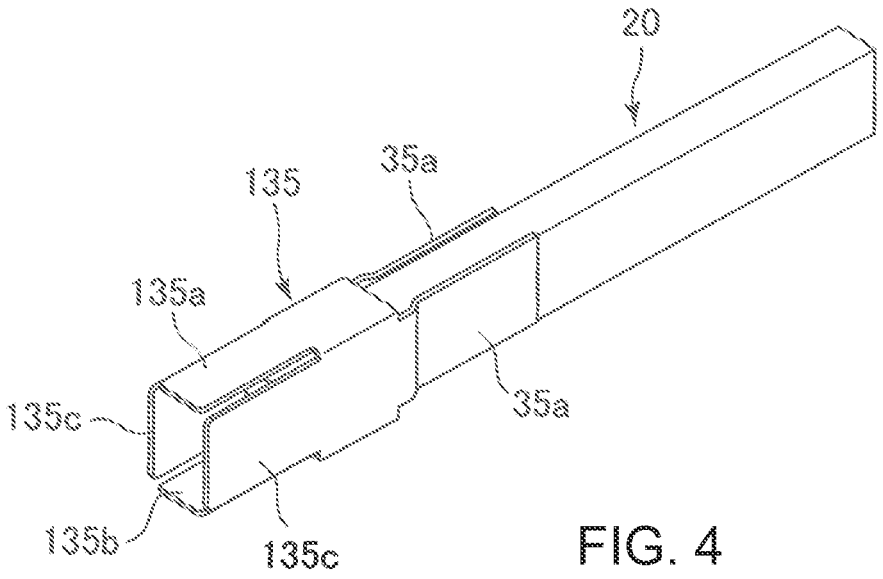
FIG. 4 is a perspective view of a conductive shield.

A slight gap may be formed in the conductive shield 35. In other words, the cross-section of the conductive shield 35 does not have to be a completely connected ring-shape. FIG. 4 is a perspective view of another example of a conductive shield. The conductive shield 135 in this drawing has a top wall portion 135*a*, a bottom wall portion 135*b*, and side wall portions 135*c*. The conductive shield 135 has a gap between two adjacent wall portions. The size of the gap does not cause significant loss during transmission of electromagnetic waves.

Figure 5:
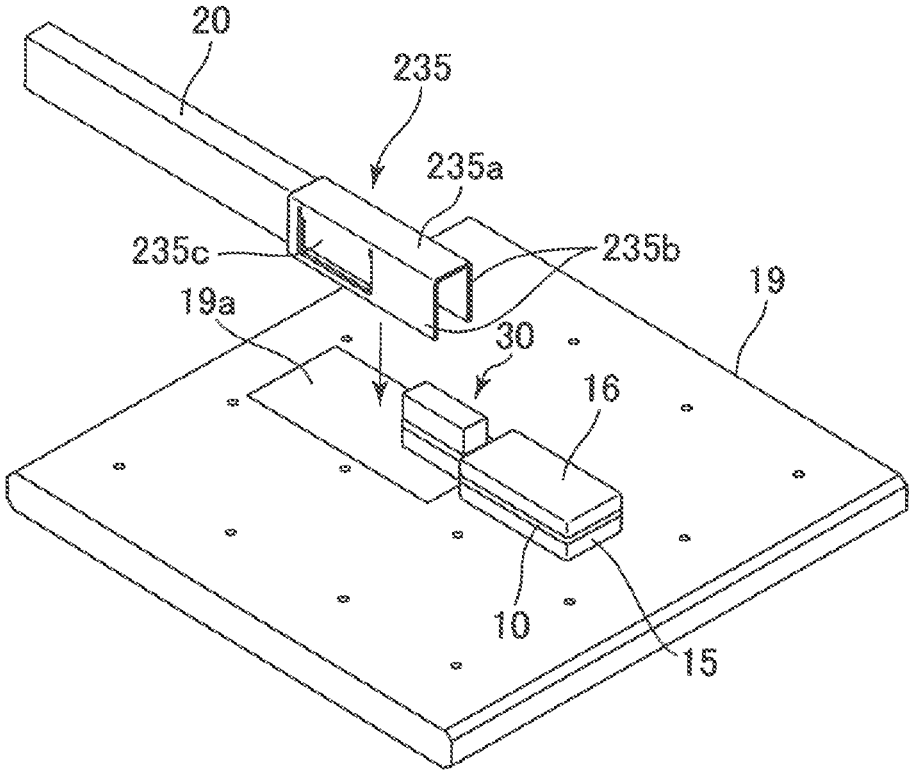
FIG. 5 is a perspective view of another example of a waveguide connected to a connecting portion.

FIG. 5 is a perspective view of another example of a waveguide 20 connected to a connecting portion 30. In the example shown, circuit board 10 is arranged on top of circuit board 19, and connected electrically to terminals formed on the circuit board 19. More specifically, circuit board 10 is connected to terminals on circuit board 19 via through-holes (not shown) formed in an insulating material 15 formed on the bottom surface. The height of the insulating material 15 corresponds to the height (thickness) of the second half 31B of FIG. 1(*a*), and circuit board 10 and the mounting portion 11*a* are arranged horizontally (in other words, arranged horizontally along with circuit board 19). In the example shown in FIG. 5, the top surface of the circuit board 10 (the surface on which the IC chip 12 is mounted) is covered by the insulating material 16.

In the example shown in FIG. 5, the end portion of the waveguide 20 and the connecting portion 30 are arranged inside a conductive shield 235 made of a conductive material. The conductive shield 235 has a U-shaped cross-section opening downwards. In other words, the conductive shield 235 has a top plate portion 235*a* along the top surface of the connecting portion 30 and the waveguide 20, and side plate portions 235*b* along the side surfaces of the connecting portion 30 and the waveguide 20, but the bottom side of the conductive shield 235 is open. The conductive shield 235 can be formed by bending a metal plate.

A conductive plate 19*a* is formed above the circuit board 19. The connecting portion 30 and the end portion of the waveguide 20 are arranged on top of the conductive plate 19*a*, and the conductive shield 235 is attached to the conductive plate 19*a*. More specifically, the bottom edge of the side plate portions 235*b* of the conductive shield 235 is mounted on the conductive plate 19*a*. As a result, the conductive shield 235 surrounds the conductive plate 19*a* as well as the boundary between the connecting portion 30 and the end portion of the waveguide 20. In this way, transmission loss can be reduced even when there is misalignment or a gap between the end portion of the waveguide 20 and the connecting portion 30. Because a conductive plate 19*a* formed on the circuit board 19 is used, the height of the waveguide 20 and the connecting portion 30 can be reduced.

The conductive shield 235 also has a plate spring-like holding portion 235*c*. In this example, the holding portion 235*c* is formed in the side plate portion 235*b*. More specifically, the side plate portion 235*b* is cut along a U-shaped line, and the inside portion of the line functions as the holding portion 235*c*.

As in the case of the conductive shield 35, a part of the connecting portion 30 (the part on the waveguide 20 side) may be positioned inside the conductive shield 235, and the remaining part may remain outside of the conductive shield 235. The entire connecting portion 30 may be positioned inside the conductive shield 235. In this case, the conductive portions 32A, 32B formed on the surface of the halves 31A, 31B of FIG. 1(*a*) are not required. In this case, the connecting portion 30 may use conductive shield 235 and conductive plate 19*a* are the conductive portions instead of the conductive portions 32A, 32B formed on the surface of the halves 31A, 31B of FIG. 1(*a*).

Figure 6:
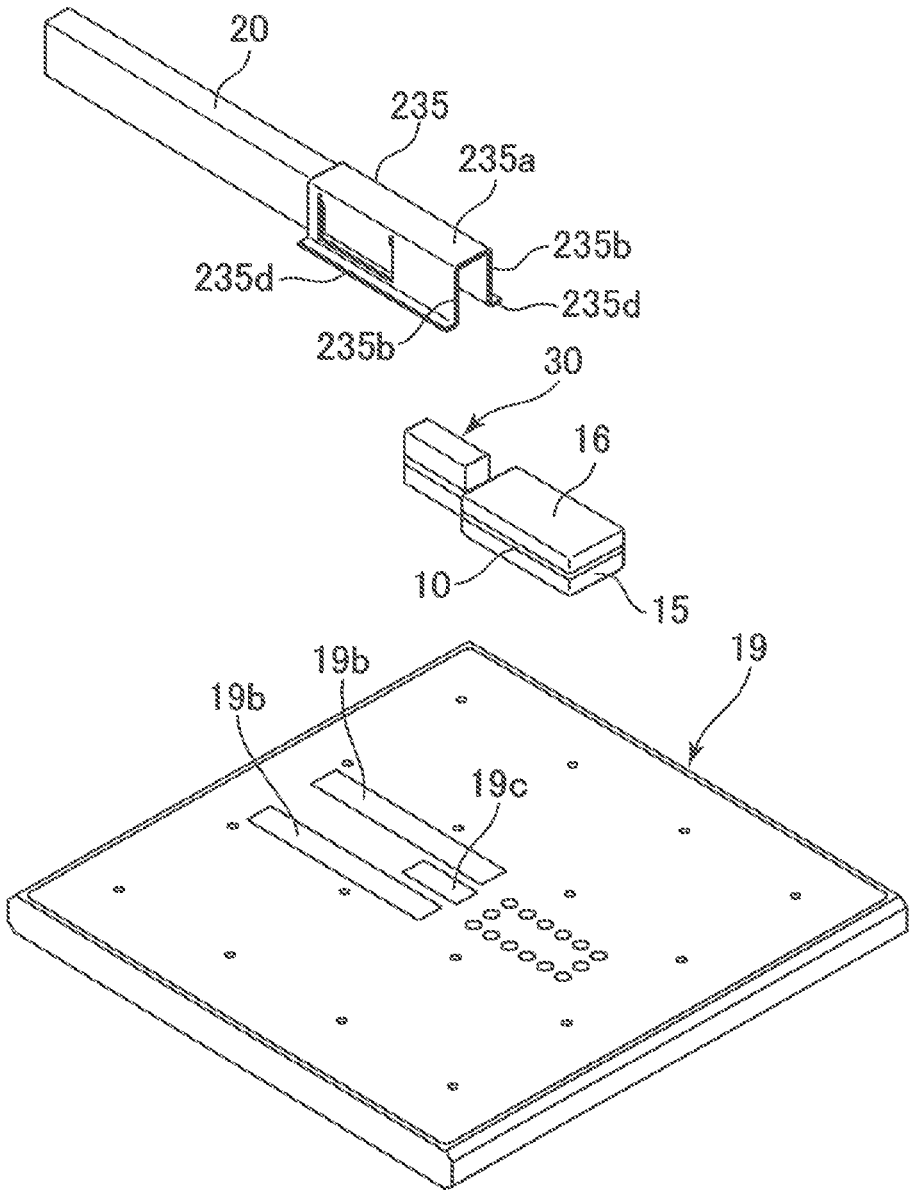
FIG. 6 is a perspective view of another example of a waveguide connected to a connecting portion.

FIG. 6 is a perspective view of yet another example of a waveguide 20 connected to a connecting portion 30. In this example, two conductive pads 19*b* and a conductive pad 19*c* arranged between them are formed in the circuit board 19 instead of a conductive plate 19*a* as in FIG. 5. The two conductive pads 19*b* are formed along the bottom edges of the side plate portions 235*b* of the conductive shield 235. The bottom edges of the side plate portions 235*b* are mounted on the conductive pads 19*b* using, for example, solder. The conductive shield 235 shown in FIG. 6 has mounting portions 235*d* formed in the shape of a flange on the bottom edges of the side plate portions 235*b*. The mounting portion 235*d* is soldered.

A connecting portion 30 is arranged on the conductive pad 19*c*. The connecting portion 30 does not have to be soldered to the conductive pad 19*c*. In this example, the conductive pad 19*c* has a width corresponding to that of the connecting portion 30 (the width in the direction orthogonal to the extension direction of the waveguide 20). The conductive pad 19*c* may have a width that is greater than that of the connecting portion 20. In this example, the conductive pad 19*c* also has a length corresponding to that of the connecting portion 30. In another example, the conductive pad 19*c* may have a length that is greater than that of the connecting portion 30. In this case, both end portions of the connecting portion 30 and the waveguide 20 may be arranged on the conductive pad 19*c*. In this case, the connecting portion 30 and the waveguide 20 may be soldered to the conductive pad 19*c*.

Figure 7:
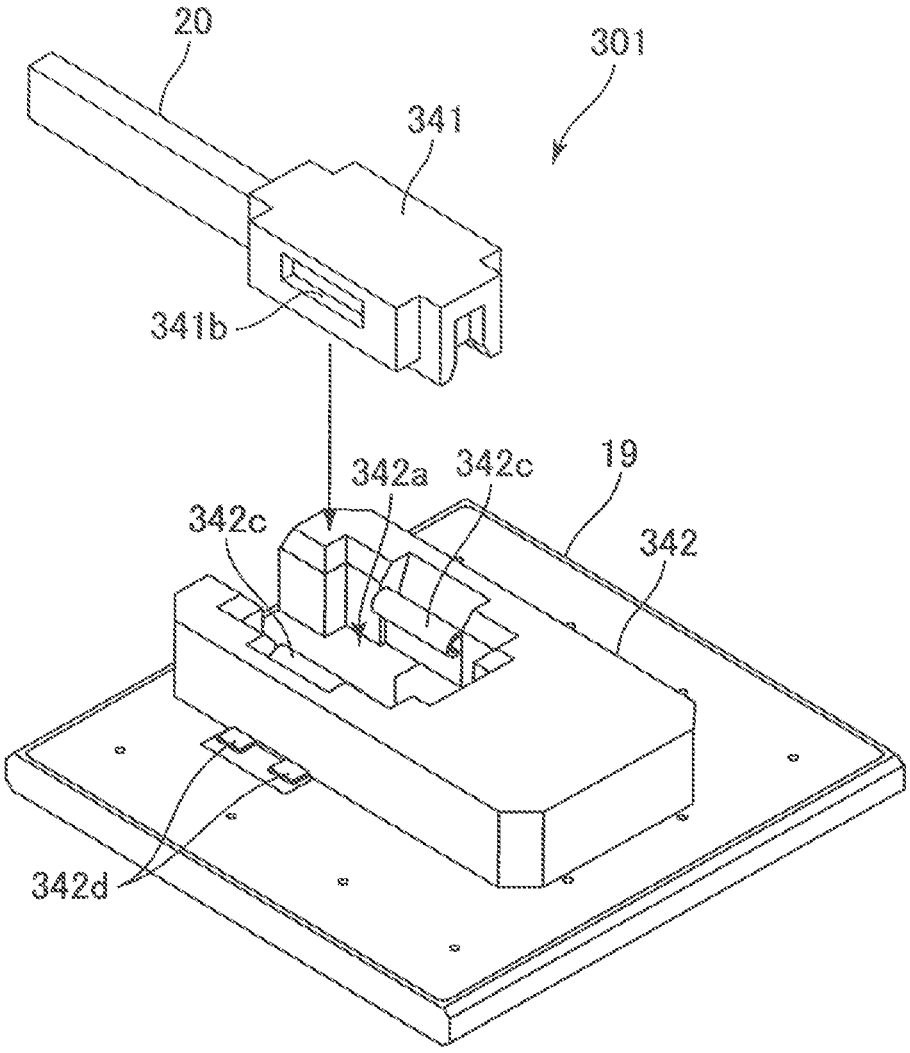
FIG. 7 is a perspective view of another example of a waveguide connected to a connecting portion.
Figure 8A:
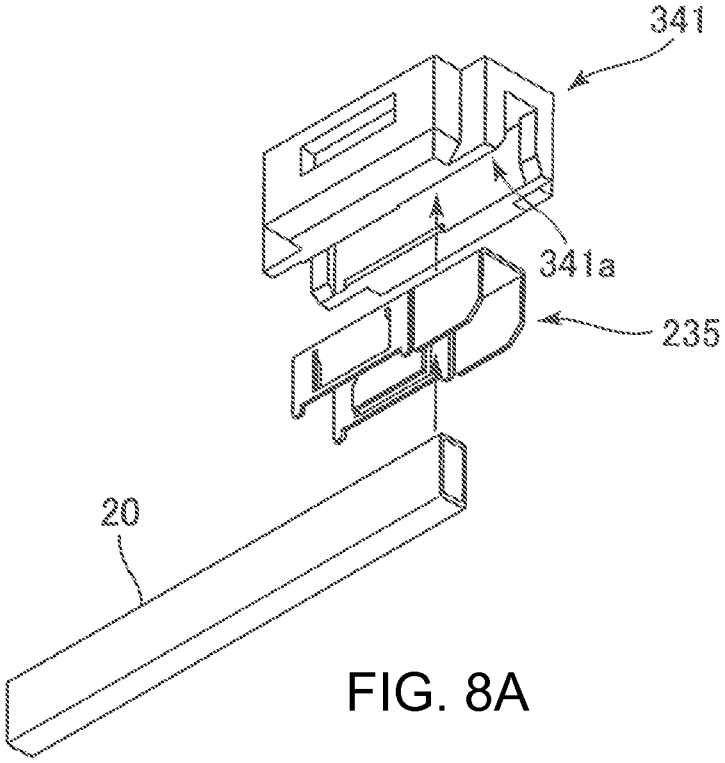
FIGS. 8(*a*) and 8(*b*) are exploded perspective views of the first connector and the second connector in FIG. 7 from below, in which FIG. 8(*a*) is an exploded perspective view from below the first connector provided on the end portion of the waveguide, and FIG. 8(*b*) is an exploded perspective view from an angle of the second connector holding the circuit board and the connecting portion.
Figure 8B:
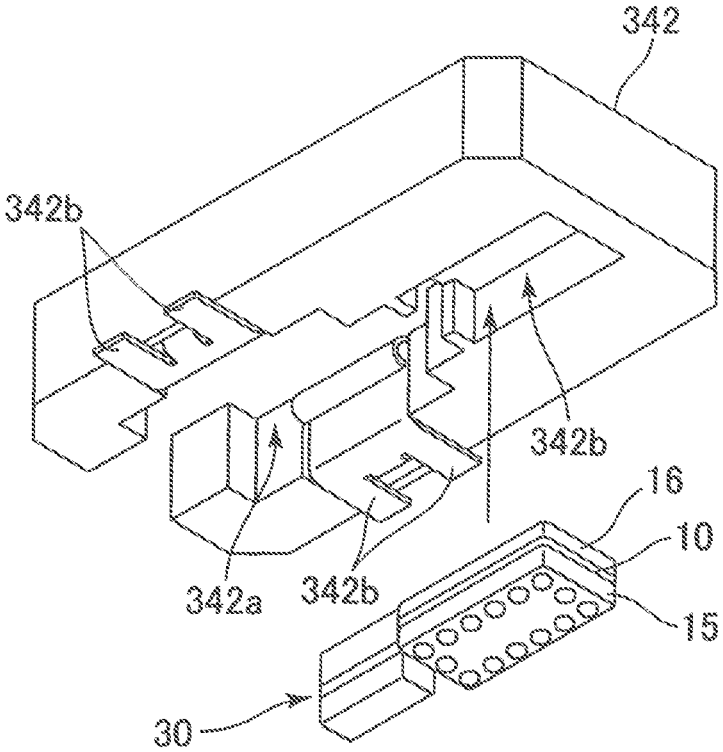

FIGS. 7, 8(*a*) and 8(*b*) show other examples of a waveguide 20 connected to a connecting portion 30 (shown in FIG. 8(*b*)). FIG. 7 is a perspective view of the high-frequency transmission device 301. The high-frequency transmission device 301 has an interconnecting first connector 341 and second connector 342. FIG. 8(*a*) is an exploded perspective view from below of the first connector 341 provided on the end portion of the waveguide 20. FIG. 8(*b*) is an exploded perspective view from an angle of the second connector 342 holding the circuit board 10 and the connecting portion 30. The connectors 341, 342 are made of resin.

As shown in FIG. 8(*a*), the conductive shield 235 described above is mounted on the end portion of the waveguide 20. The first connector 341 is formed to hold both the conductive shield 235 and the end portion of the waveguide 20. In this example, a recessed portion 341*a* is formed in the first connector 341 which is open below, and holds the end portion of the waveguide 20 and the conductive shield 235 inside the recessed portion. The recessed portion 341*a* is open in the extension direction of the waveguide 20, and the end surface of the waveguide 20 is exposed in the direction of extension. As shown in FIG. 8(*b*), the second connector 342 holds a module composed of the circuit board 10 and the connecting portion 30. In this example, a recessed portion 342*b* open below is formed in the second connector 342, and the circuit board 10 and insulating materials 16, 15 are arranged in the recessed portion 342*b* and held inside.

In this configuration, the first connector 341 and the second connector 342 can be assembled vertically (in the thickness direction of the circuit board 10). In this example, as shown in FIG. 7, a housing portion 342*a* is formed in the second connector 342 to house the first connector 341. The first connector 341 can be inserted into the housing portion 342*a* from above.

The connecting portion 30 (not shown) is positioned inside the housing portion 342*a*. When the first connector 341 is inserted into the housing portion 342*a* of the second connector 342, the end surface 31*a* of the connecting portion 30 and the end surface of the waveguide 20 face each other. The conductive shield 235 also surrounds the connecting portion 30 and the end portion of the waveguide 20. By using these connectors 341, 342, the waveguide 20 and the connecting portion 30 are easy to connect.

A locking mechanism is provided in the connectors 341, 342 to prevent them from unintentionally coming loose. In the example shown in FIGS. 7, 8(*a*) and 8(*b*), a recessed portion 341*b* shown in FIG. 7 is formed in a side surface of the first connector 341. A protruding portion 342*c* shown in FIG. 7 is formed on the inside surface of the housing portion 342*a* of the second connector 342. The protruding portion 342*c* is formed, for example, from a metal plate, and can bend elastically. When the first connector 341 is inserted into the housing portion 342*a* of the second connector 342, the protruding portion 342*c* is inserted into the recessed portion 341*b*. In the example shown in FIGS. 7, 8(*a*) and 8(*b*), the metal plate forming the protruding portion 342*c* has a leg portion 342*d* shown in FIG. 7. The leg portion 342*d* is soldered to the conductive pad 19*b* formed in the circuit board 19 shown in FIG. 7.

Figure 9:
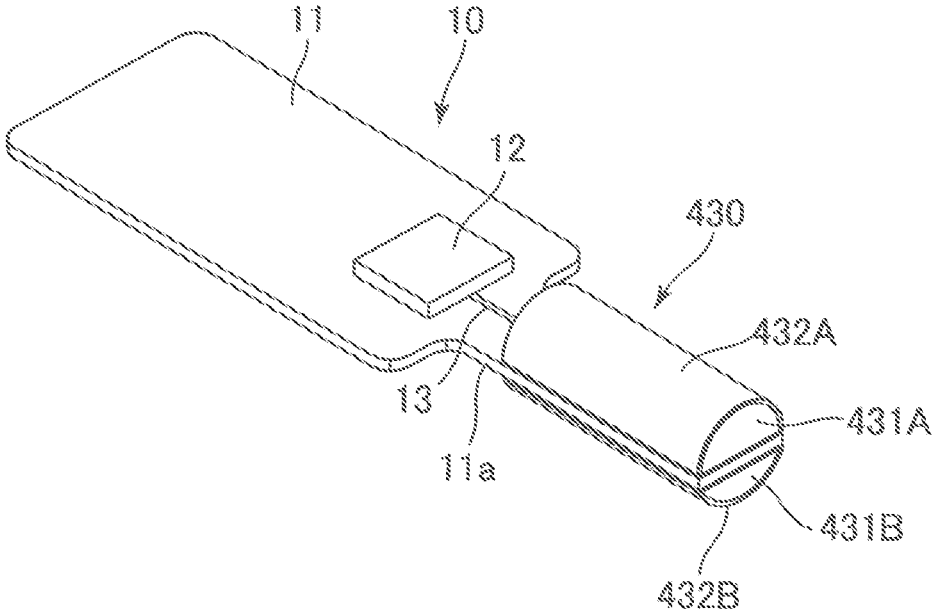
FIG. 9 is a perspective view of a modified example of a connecting portion.

FIG. 9 is a perspective view of a connecting portion 430 which is a modified example of connecting portion 30. The following explanation focuses on the differences between connecting portion 430 and connecting portion 30. The components that are not explained are identical to those in FIGS. 1-2.

The connecting portion 430 includes a first half 431A and a second half 431B made of a dielectric material. First half 431A and second half 431B are arranged opposite each other with the antenna 13 interposed between them in the thickness direction of the circuit board 10. Together, the halves have a round cross-section. In other words, the cross-section of the first half 431A and the cross-section of the second half 431B are semicircular. The outer surface of the first half 431A of the connecting portion 430 has a conductive portion 432A. Similarly, the outer surface of the first half 431B of the connecting portion 430 has a conductive portion 432B. The conductive portions 432A, 432B surround the two halves 431A, 431B in a cross-section orthogonal to the direction of the circuit board 10 (more specifically, in the extension direction of the antenna 13 and the waveguide). In other words, together, the conductive portions 432A, 432B form a tube-shape which surrounds the antenna 13 and the halves 431A, 431B.

The connecting portion 430 and the waveguide connected to the connecting portion 430 (not shown) have complementary cross-sectional shapes. In other words, the waveguide connected to the connecting portion 430 has a round cross-section. This waveguide has a dielectric portion with a round cross-section, and a conductive portion covering the outer peripheral surface of the dielectric portion. The waveguide is arranged so that its end surface is aligned with the end surface of the connecting portion 430, and the first half 431A and the second half 431B are both connected to the waveguide in the extension direction of the waveguide. These components may be connected to each other using any of the connection methods explained with reference to FIGS. 4-7, 8(*a*) and 8(*b*). Here, for example, the conductive shield 35 shown in FIG. 3 is formed with a round cross-section. The conductive shield 235 shown in FIG. 5 is curved so that the top plate portion 235*a* is aligned with the connecting portion 430 and the waveguide.

Figure 10:
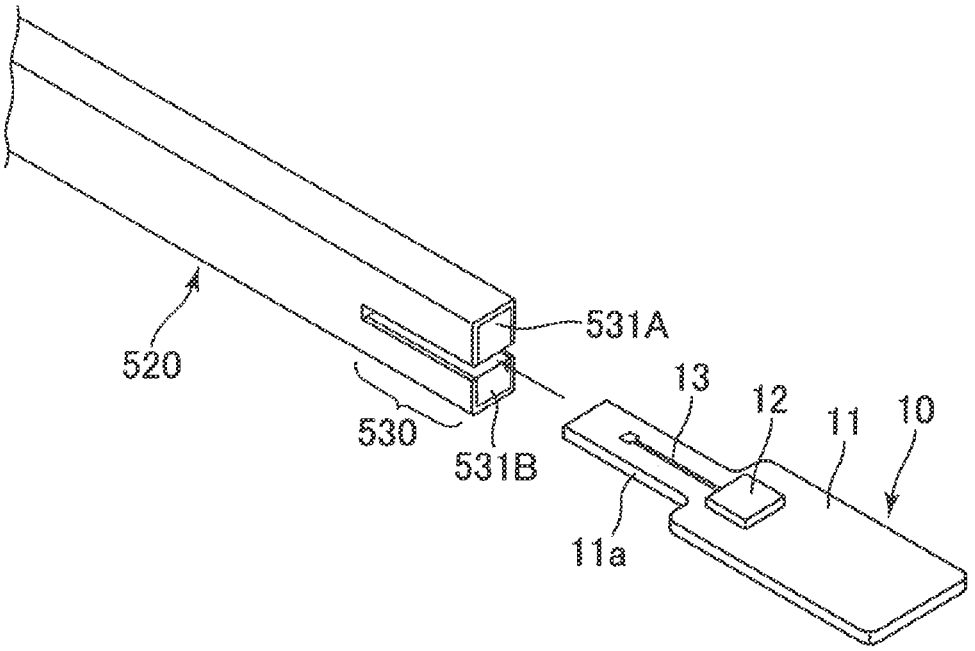
FIG. 10 is a perspective view of another modified example of a connecting portion.

FIG. 10 is a perspective view of another modified example of a connecting portion 30. The following explanation focuses on the differences in the connecting portion 30. The components that are not explained are identical to those in FIGS. 1-2.

The structure of the waveguide 520 shown in FIG. 10 is substantially identical to the waveguide 20 described above. In other words, the waveguide 520 has a tube-shaped conductive portion and a dielectric portion arranged inside. A protective portion is also provided on the surface of the waveguide 520 to cover the conductive portion. A connecting portion 530 is provided on the end portion of the waveguide 520. The connecting portion 530 is integrated with the waveguide portion 520.

The dielectric portion of the connecting portion 530 has a first half 531A and a second half 531B positioned opposite each other to interpose the antenna 13 in the thickness direction of the circuit board 10. The first half 531A and the second half 531B are each connected integrally with the waveguide 520 in the extension direction of the waveguide 520. In other words, the first half 531A extends from the upper portion of the waveguide 520, and the second half 531B extends from the lower portion of the waveguide 520. A space corresponding to the thickness of the mounting portion 11*a* of the circuit board 10 is provided between the first half 531 and the second half 531B, and the mounting portion 11*a* is inserted into the space.

The outer surface of the first half 531A and the outer surface of the second half 531B are covered by the conductive portions extending from the waveguide 520. Together, the conductive portions formed in the halves 531A, 531B have a cross-sectional shape corresponding to the conductive portions provided in the waveguide 520 and form a tube which surrounds the antenna 13. In the example shown in FIG. 10, the conductive portions formed in the halves 531A, 531B do not have to have a rectangular shape. They may also have a round shape.

Figure 11:
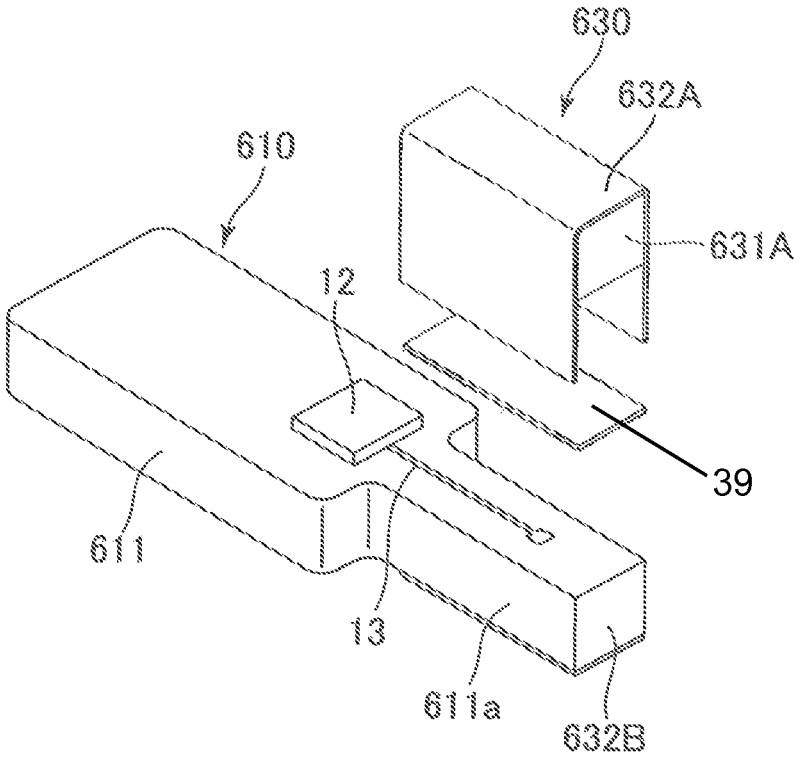
FIG. 11 is a perspective view of a modified example of a connecting portion and a circuit board.

FIG. 11 is a perspective view of a modified example of a connecting portion and a circuit board. The following explanation focuses on the differences with respect to the connecting portion 30 and the circuit board 10 of FIGS. 1(*a*) and 1(*b*). The components that are not explained are similar to those explained in FIGS. 1(*a*), 1(*b*) and 2.

The circuit board 610 shown in FIG. 11 has a base 611. The base 611 has a mounting portion 611*a* in which the antenna 13 is formed. The connecting portion 630 has a first half 631A. The mounting portion 611*a* of the base 611 and the first half 631A are positioned opposite from each other with the antenna 13 interposed in the thickness direction of the circuit board 610. The mounting portion 611*a* is thicker than the mounting portion 11*a* of the circuit board 10 explained earlier. The thickness of the mounting portion 611*a* (that is, the thickness of the base 611) is determined by the wavelength of the electromagnetic waves sent and received by the antenna 13, and the relative permittivity of the base 611. The first half 632A is mounted on the circuit board 610 using an adhesive sheet 39.

A first conductive portion 632A and a second conductive portion 632B are provided in the connecting portion 630. The first conductive portion 632A covers the upper surface of the first half 631A as well as the side surfaces of the first half 631A and the side surfaces of the mounting portion 611*a*. The second conductive portion 632B is provided on the bottom surface of the mounting portion 611*a*. As a result, the first conductive portion 632A and the second conductive portion 632B surround the first half 631A and the mounting portion 611*a* in the cross-section orthogonal to the direction of the circuit board 610. The first conductive portion 632A and the second conductive portion 632B have a shape corresponding to that of the conductive portion 22 of the waveguide 20 in cross-section. In other words, in this example, the mounting portion 611*a* functions as the second half of the connecting portion 630. In the example shown in FIG. 11, the first conductive portion 631A and the second conductive portion 632B together have a rectangular cross-section.

Figure 12:
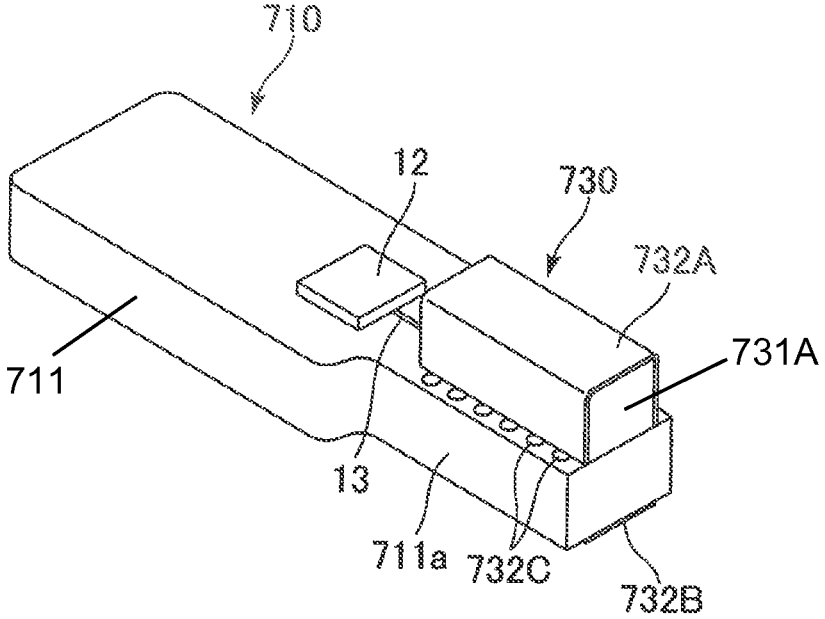
FIG. 12 is a perspective view of another modified example of the connecting portion and the circuit board in FIG. 11.

FIG. 12 is a perspective view of another modified example of a connecting portion and a circuit board. The following explanation focuses on the differences between this example and the example shown in FIG. 11. The components that are not explained are identical to those in FIG. 11.

The circuit board 710 shown in FIG. 12 has a base 711. The base 711 has a mounting portion 711*a* in which an antenna 13 is formed. The connecting portion 730 has a first half 731A. The mounting portion 711*a* of the base 711 and the first half 731A are arranged opposite from each other so as to interpose the antenna 13 in the thickness direction of the circuit board 710.

The connecting portion 730 has a first conductive portion 732A, a second conductive portion 732B, and a plurality of third conductive portions 732C. The first conductive portion 732A covers the top surface of the first half 731A, and covers the side surfaces of the first half 731A as well. The second conductive portion 732B is provided on the bottom surface of the mounting portion 711*a*. A plurality of through-holes is formed in rows along the antenna 13 in the base 711. Two rows of through-holes are formed, and the antenna 13 is positioned between these rows. The conductors formed in the through-holes are the third conductors 732C. Each of the third conductive portions 732C extends from the bottom edge of the first conductive portion 732A towards the second conductive portion 732B. A plurality of third conductive portions 732A is also arranged alongside the antenna 13. As a result, the conductive portions 732A, 732B and 732C, surrounds the region from the first half 731A and the two rows of conductive portions 732C in the mounting portion 711*a* of the base 711 in cross-section orthogonal to the direction in which the circuit board 710 is arranged. In other words, the two-column conductive portion 732C in the mounting portion 711*a* of the base 711 functions as the second half described earlier.

Conductive portions 732A, 732B and 732C are arranged in a tube shape following the example of the conductive portion 22 of the waveguide 20 shown in FIG. 2. In other words, the conductive portions 732A, 732B and 732C have a cross-sectional shape orthogonal to the direction in which the circuit board 710 is arranged which corresponds to the conductive portion 22 of the waveguide 20. In FIG. 11, the conductive portions 732A, 732B and 732C have a rectangular cross-section.

While a preferred embodiment of the Present Disclosure is shown and described, it is envisioned that those skilled in the art may devise various modifications without departing from the spirit and scope of the foregoing Description and the appended Claims.

What is claimed is:

1. A high-frequency transmission device for transmitting electromagnetic waves, the high-frequency transmission device comprising:

a base formed on a circuit board from an insulating material, wherein a thickness of the base is less than a wavelength of the electromagnetic waves;

an antenna formed on the base;

a waveguide, the waveguide including a conductive portion and a dielectric portion, the conductive portion surrounding the dielectric portion in cross-section orthogonal to an extension direction, and a connecting portion provided on an end portion of the waveguide, the connecting portion including at least one conductive portion and a dielectric portion, the dielectric portion of the connecting portion including a first half and a second half interposing there between the antenna in a thickness direction of the circuit board, each conductive portion of the connecting portion respectively surrounding the first half and the second half in cross-section orthogonal to the extension direction and having a shape corresponding to the conductive portion of the waveguide, wherein at least one of the first half and the second half is separate from the waveguide and wherein the end portion of the waveguide is held by a first connector.

2. The high-frequency transmission device of claim 1, wherein at least one of the first half and the second half is separate from the dielectric portion of the waveguide.

3. The high-frequency transmission device of claim 2, wherein a boundary between the end portion of the waveguide and at least one of the first half and the second half is covered by a conducting shield.

4. The high-frequency transmission device of claim 1, wherein the end portion of the wave guide extends in the extension direction.

5. The high-frequency transmission device of claim 4, wherein the first half and the second half each connect to the waveguide in the extension direction.

6. The high-frequency transmission device of claim 1, wherein the connecting portion is held by a second connector mated with the first connector.

7. The high-frequency transmission device of claim 1, wherein at least one of the first half and the second half is integrated with the dielectric portion of the waveguide.

* * * * *